US006839922B1

(12) United States Patent
Foggett et al.

(10) Patent No.: US 6,839,922 B1
(45) Date of Patent: Jan. 11, 2005

(54) HEATED INFLATABLE AIR BED

(76) Inventors: James A. Foggett, 1538 Lago Vista Blvd., Palm Harbor, FL (US) 34685; Christopher James Foggett, 2251 Indian Key Dr., Holiday, FL (US) 34691

( * ) Notice: Subject to any disclaimer, the term of this patent is extended or adjusted under 35 U.S.C. 154(b) by 0 days.

(21) Appl. No.: 10/705,624

(22) Filed: Nov. 10, 2003

(51) Int. Cl.[7] ..... A47C 21/04

(52) U.S. Cl. ..... 5/421; 5/706; 5/710; 219/212; 219/217

(58) Field of Search ..... 5/421, 422, 706, 5/710; 219/212, 217

(56) References Cited

U.S. PATENT DOCUMENTS

| | | | | |
|---|---|---|---|---|
| RE22,763 | E | | 6/1946 | Clark |
| 2,606,996 | A | | 8/1952 | Westerberg et al. |
| 3,380,087 | A | | 4/1968 | Petty et al. |
| 4,162,393 | A | | 7/1979 | Balboni |
| 4,388,738 | A | * | 6/1983 | Wagner ..... 5/421 |
| 4,423,308 | A | * | 12/1983 | Callaway et al. ..... 219/217 |
| 4,459,461 | A | * | 7/1984 | Spencer ..... 219/212 |
| 4,798,936 | A | | 1/1989 | Johnson, Sr. |
| 5,528,779 | A | * | 6/1996 | Lee et al. ..... 5/413 AM |
| 5,787,525 | A | * | 8/1998 | Sugihara et al. ..... 5/421 |
| 5,835,983 | A | * | 11/1998 | McMahen et al. ..... 219/527 |
| 5,881,410 | A | | 3/1999 | Yamada |
| 6,353,207 | B1 | * | 3/2002 | Burt ..... 219/217 |

OTHER PUBLICATIONS

Bestway 04', "Flocked & Fabric Products—Comfort Quest," catalog, 2004 ed., Bestway Int'l Sales Office & Manufacturing (Shanghai, China), p. 142–143, (Jan. 1, 2004).

* cited by examiner

*Primary Examiner*—Michael Trettel
(74) *Attorney, Agent, or Firm*—Larson & Larson, PA; Herbert W. Larson

(57) ABSTRACT

A top vinyl layer, a bottom vinyl later and side vinyl layer are all heat welded together along peripheral edges. A heated blanket has a vinyl strip attached to its peripheral edges and such vinyl strip is heat welded to the top vinyl layer.

20 Claims, 6 Drawing Sheets

HEATED INFLATABLE AIR BED

BACKGROUND OF THE INVENTION

The invention relates to inflatable air beds. More specifically, it refers to an air bed having a vinyl layer enclosing an inflatable air space and a heated blanket sealed together along exterior edges.

Mattresses containing a heating unit are well known as shown in Reissue Pat. No. 22,763; U.S. Pat. Nos. 2,606,996; 4,162,393; 4,388,738; 4,423,308; 5,787,525 and 5,881,410. The heating of a mattress is a desirable condition, particularly in cold climates. For this reason, many popular heated mattress designs have been developed. Vinyl layers typically employed over inflatable air mattresses are difficult to heat and improved ways to achieve such heating is sought.

SUMMARY OF THE INVENTION

A way of inexpensively heating an air mattress is created by this invention. A blanket containing an electrical heating element has a vinyl strip attached to its peripheral edges and such edges are heat welded to a top vinyl layer of an air bed. The peripheral edges of the top vinyl layer, a side vinyl layer and bottom vinyl layer are all heat welded together to form the air mattress. Support coils are mounted between the top and bottom vinyl layers. A fixture for receipt and expulsion of air is located on the side vinyl layer and an electrical conduit is connected to the electrical heating element in the blanket.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
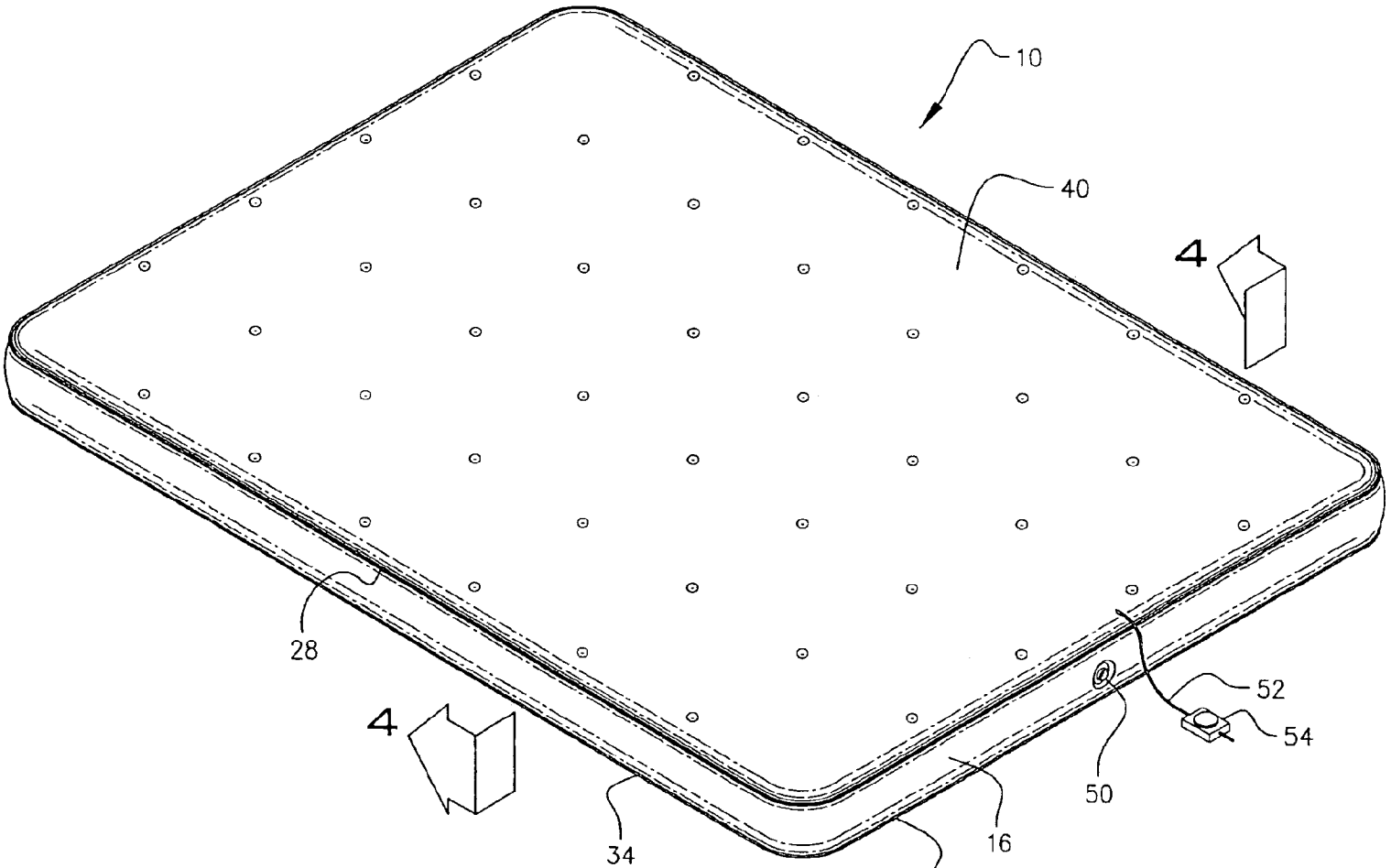
FIG. 1 is a perspective view of the heated air mattress of this invention.

Throughout the following detailed description, the same reference numerals refer to the same elements in all figures.

Figure 2:
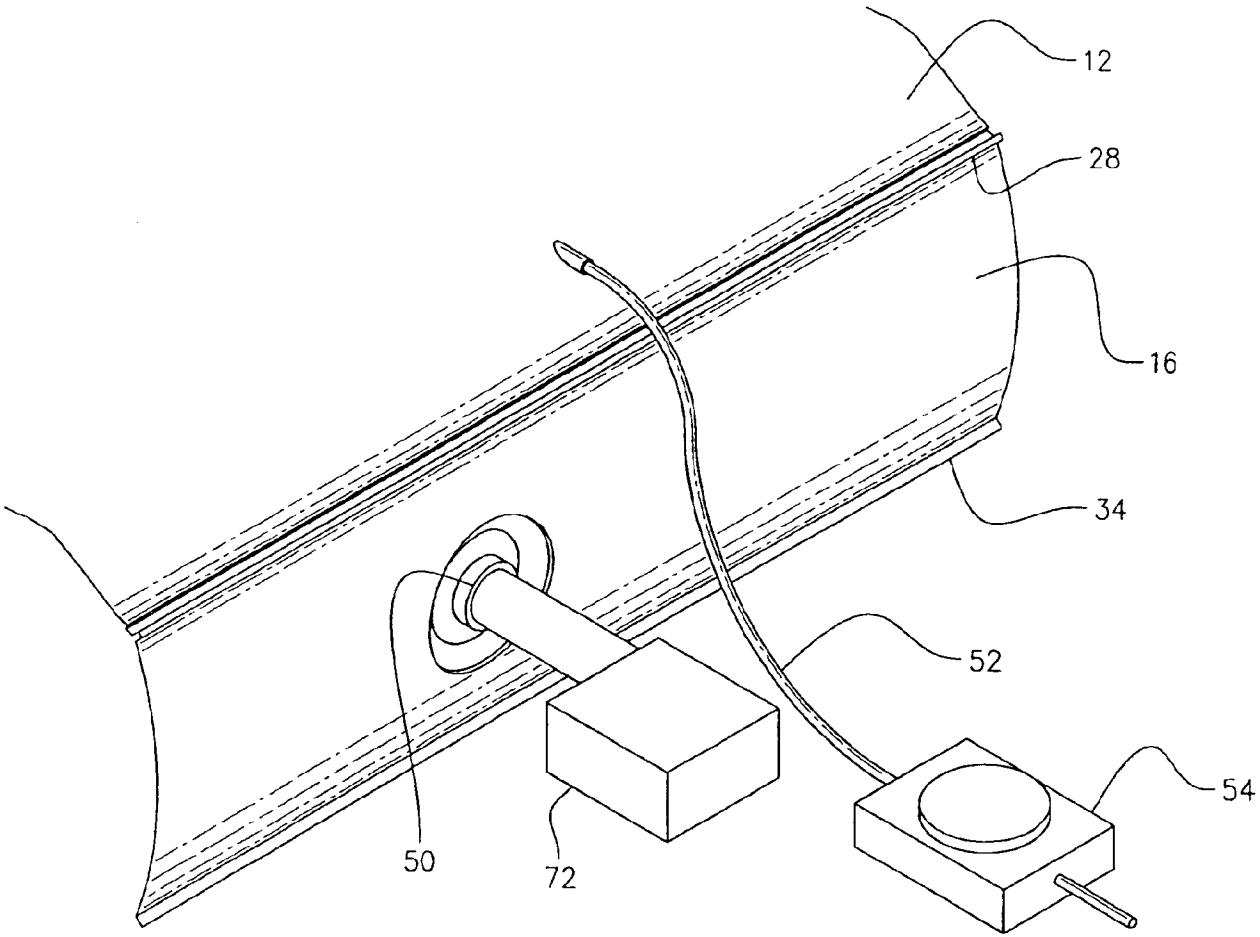
FIG. 2 is a magnified view of the air intake fixture and the electric conduit serving the heated blanket within the air mattress.
Figure 3:
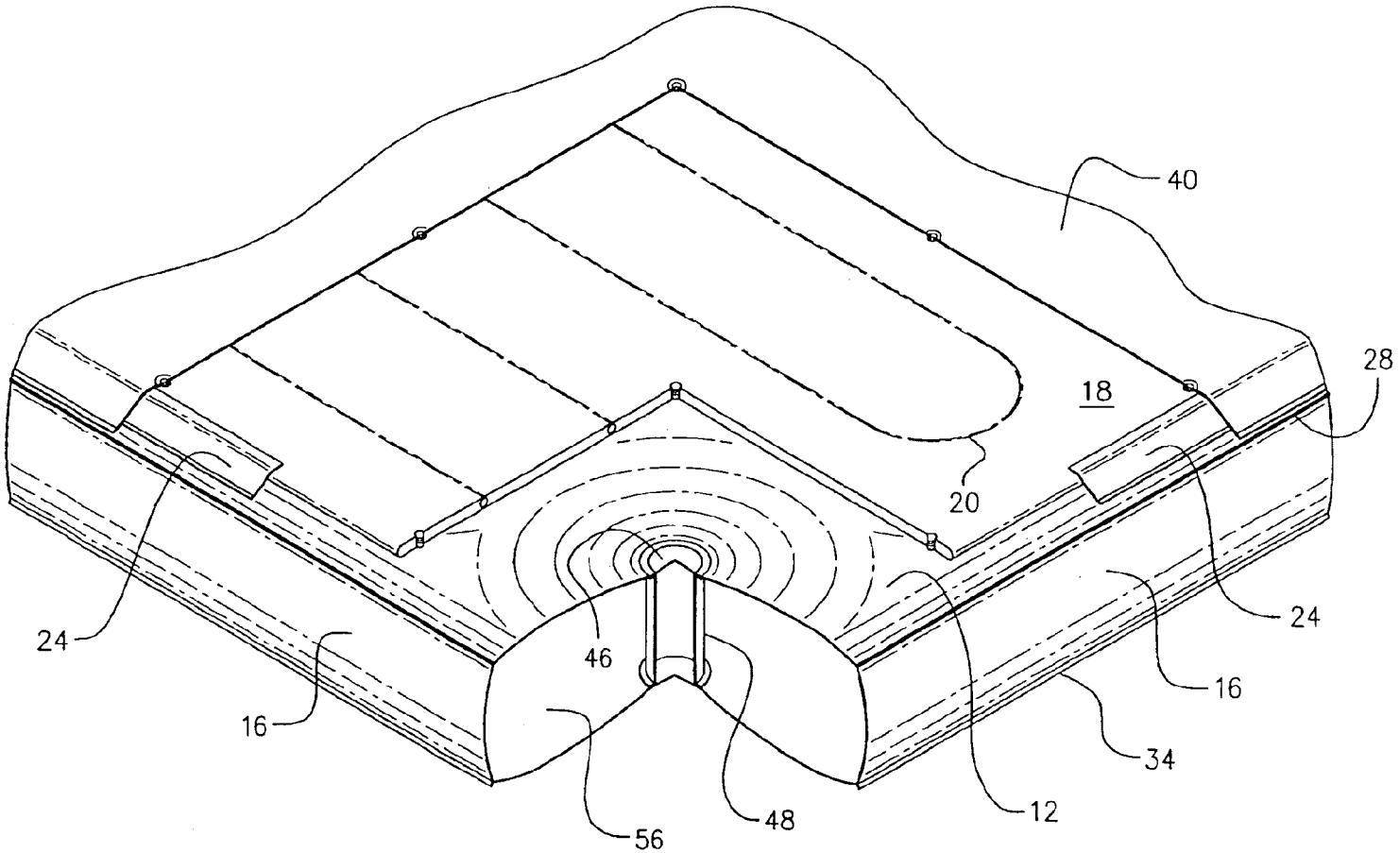
FIG. 3 is a partially sectioned view of the air mattress showing the internal elements.
Figure 4:
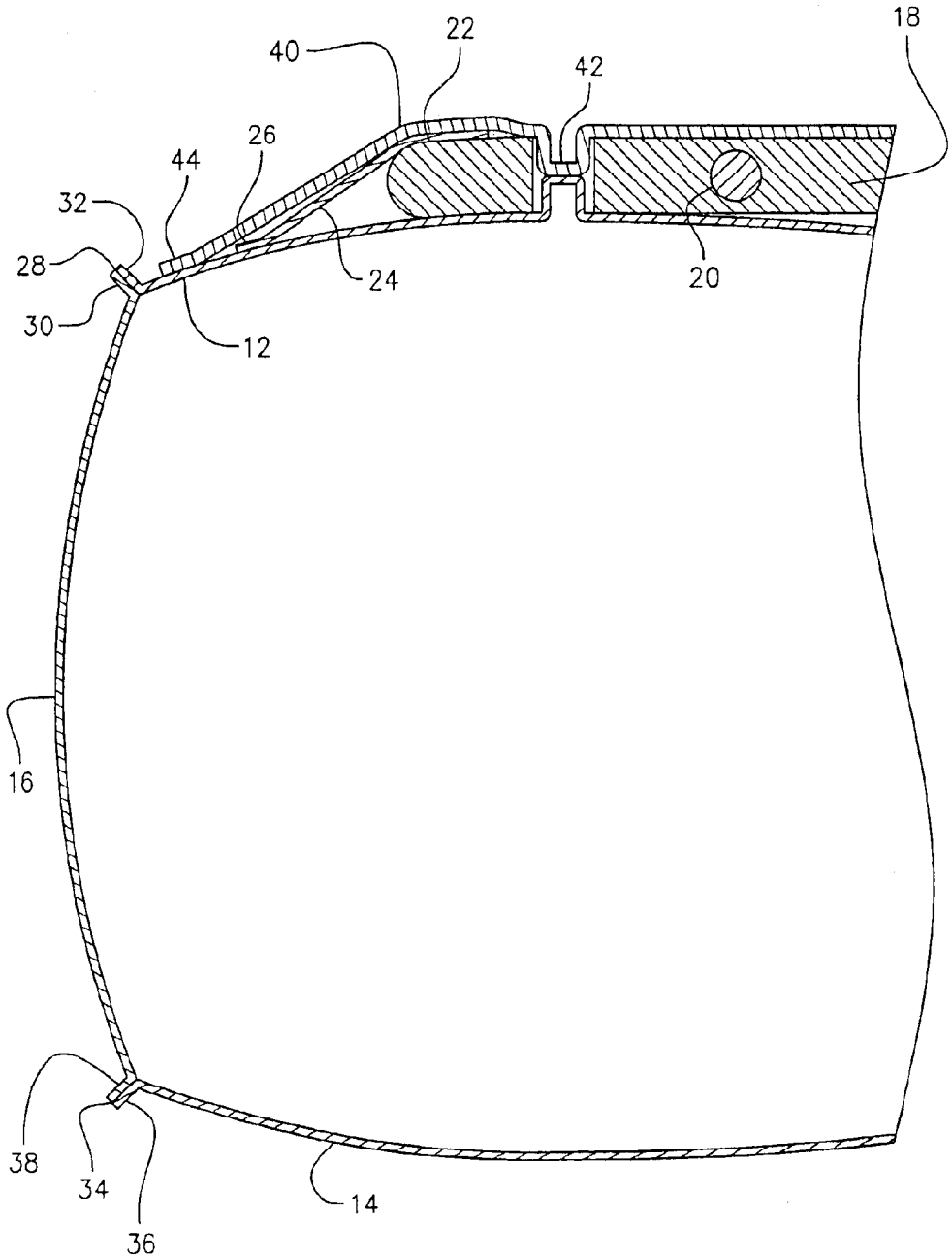
FIG. 4 is an elevational sectional view of the air mattress along lines 4—4 of FIG. 1.

Referring to FIGS. 1–4, the heated inflatable air bed or mattress 10 has a top vinyl layer 12, a bottom vinyl layer 14 and a side gusset vinyl layer 16. As seen in FIGS. 3 and 4, a heated blanket 18 having a heating element 20 within blanket 18 is attached by stitching along a peripheral edge 22, to a vinyl strip 24. The blanket can be made from wool, cotton or synthetic fiber. The blanket 18 is juxtaposed to top vinyl layer 12 by heat welding 26 the vinyl strip 24 to the top vinyl layer 12 as seen in FIG. 4. The top vinyl layer 12 is heat welded 28 along its peripheral edge 32 to a top edge 30 of the gusset 16. The bottom vinyl layer 14 is heat welded along its peripheral edge 36 to a bottom edge 38 of the gusset 16. A vinyl flock 40 covers the blanket 18. The flock 40 is heat welded 42, 44 to the top vinyl layer 12.

Multiple coils 46 having vinyl vertical supports or pillars 48 are distributed between the top vinyl layer 12 and bottom vinyl layer 14 to provide support to the inflated air bed.

Inflation of the air bed is accomplished by hand pumping or with a battery powered blower 72 through fixture 50 as seen in FIG. 2. The heating elements 20 in blanket 18 are attached to an electrical conduit 52 which is attached to an electric current source via a rheostat 54. Air can be released from air bed 10 by opening a plug in fixture 50. As air enters fixture 50, the air chamber 56 enclosed by the top, bottom and side vinyl layers inflates.

Figure 5:
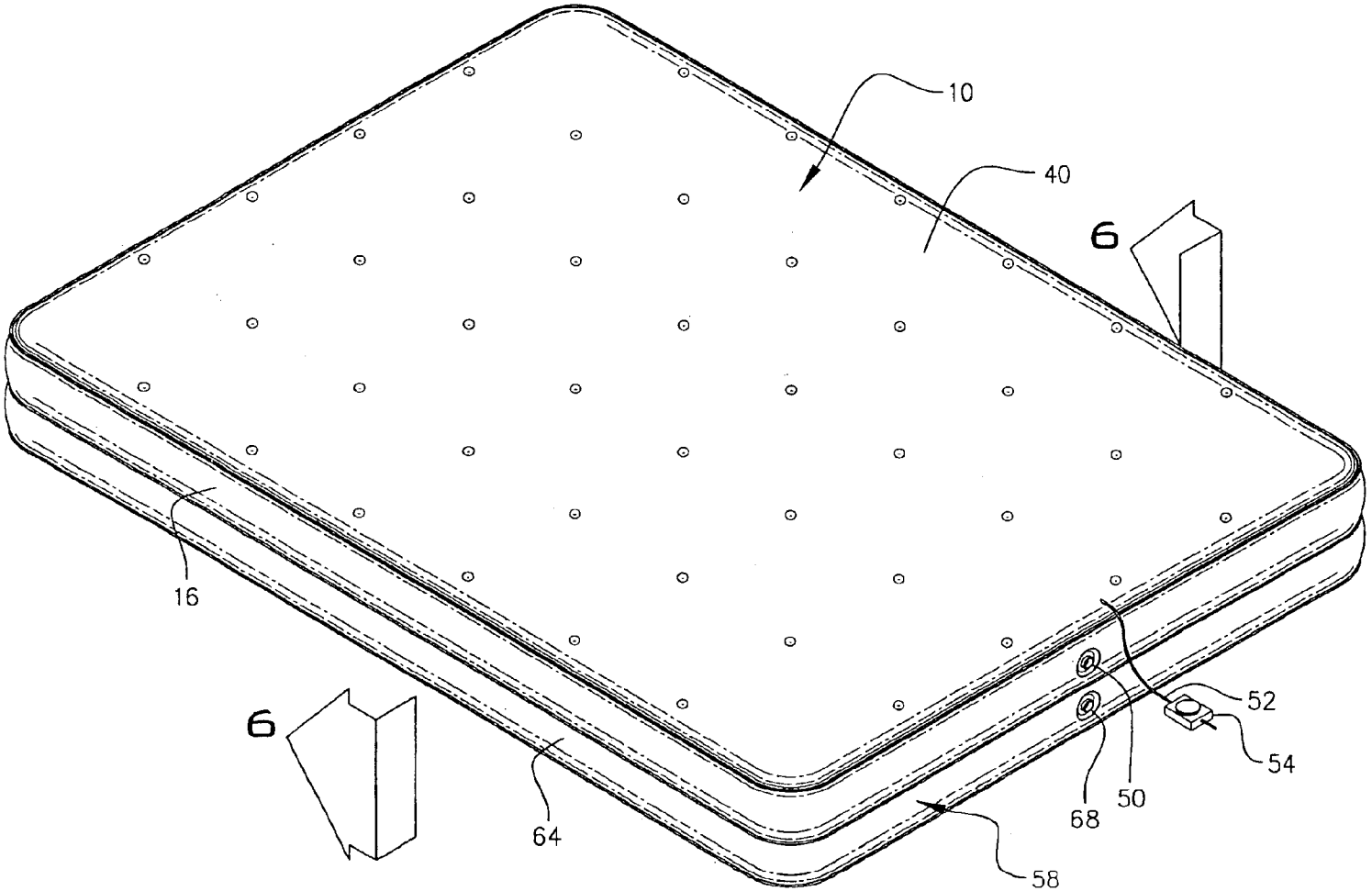
FIG. 5 is a perspective view of an alternate heated air mattress.
Figure 6:
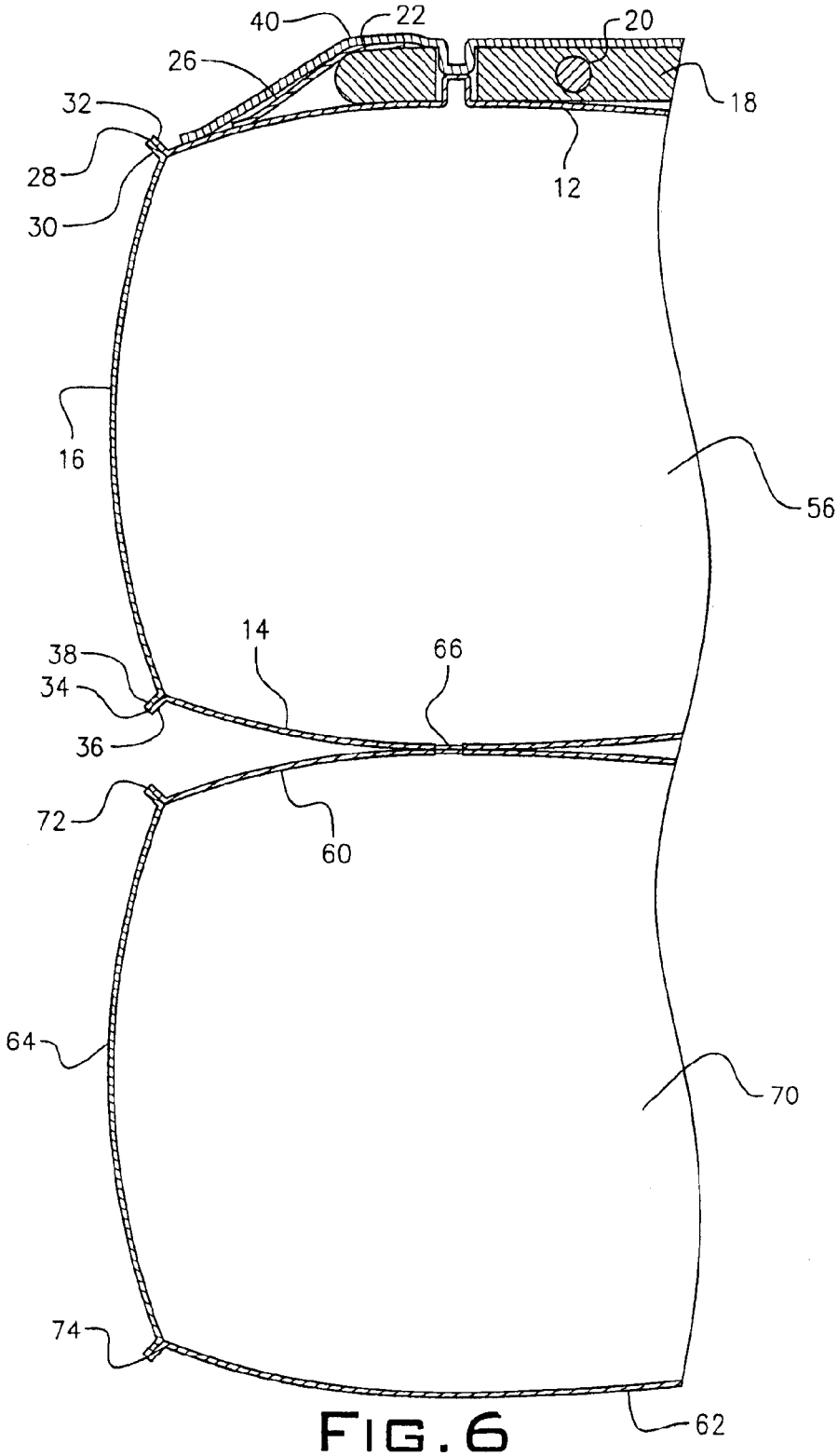
FIG. 6 is an elevational sectional view along lines 6—6 of FIG. 5.

As seen in FIGS. 5 and 6, a second air bed 58 having a top vinyl layer 60, a bottom vinyl later 62 and a side gusset layer 64 can be attached to air bag 10 by a weld 66 between bottom vinyl layer 14 and top vinyl layer 60 of air bed 58. The second air bed 58 has a separate air intake/outflow fixture 68 for filling its air chamber 70. In like manner to bed 10, the top layer 60 and top edge of side layer 64 are welded together at 72 and the bottom layer 62 is welded 74 to the bottom edge side 64.

Other functionally equivalent elements can be substituted for the elements disclosed herein to produce substantially the same results in substantially the same way.

Having disclosed the invention, what is claimed for Letters Patent follows:

1. A heated inflatable air bed comprising:

a top vinyl layer having a peripheral edge;

a bottom vinyl layer having a peripheral edge;

a side gusset vinyl layer having a top and bottom peripheral edge;

a blanket containing a heating element, the blanket having a vinyl strip attached to a peripheral edge, the vinyl strip heat welded to the top vinyl layer;

the peripheral edge of the top vinyl layer heat welded to the top peripheral edge of the side gusset vinyl layer;

the peripheral edge of the bottom vinyl layer heat welded to the bottom peripheral edge of the side gusset vinyl layer;

a means for blowing air into the air bed penetrating a portion of the vinyl layers;

an electrical conduit connectable to a source of electric current at one end and connected at a second end to the heating element;

means between the top and bottom vinyl layers for supporting the air bed when inflated.

2. The heated inflatable air bed according to claim 1 wherein the vinyl strip is attached to the blanket by stitching.

3. The heated inflatable air bed according to claim 1 wherein the electrical conduit is connected in series to a rheostat.

4. The heated inflatable air bed according to claim 1 wherein the means for supporting the top and bottom vinyl layers are multiple coils positioned between the top and bottom vinyl layers.

5. The heated inflatable air bed according to claim 1 wherein the bottom vinyl layer is heat welded to a top vinyl layer of a second air bed.

6. A heated inflatable air mattress comprising:

a top vinyl layer heat welded along a peripheral edge to a top edge of a vinyl side gusset;

a bottom vinyl layer heat welded along a peripheral edge to a bottom edge of the vinyl side gusset;

a heating element imbedded in a blanket, the blanket having a vinyl strip attached to a peripheral edge, the vinyl strip heat welded to the top vinyl layer;

a means for inserting air into the air mattress penetrating a portion of one vinyl layer;

an electrical conduit connectable to a source of electric current at one end and connected at a second end to the heating element; and a means for supporting the air mattress when inflated.

7. The heated inflatable air mattress according to claim 6 wherein the vinyl strip is stitched to the peripheral edge of the blanket.

8. The heated inflatable air mattress according to claim 6 wherein the electrical conduit is connected to a rheostat at one end and at a second end to the heating element.

9. The heated inflatable air mattress according to claim 6 wherein a vinyl flock covers the blanket.

10. The heated inflatable air mattress according to claim 9 wherein a peripheral edge of the vinyl flock is heat welded to the top vinyl layer.

11. The heated inflatable air mattress according to claim 10 wherein the peripheral edge of the vinyl flock is heat welded to the top vinyl layer outboard of where the vinyl strip edge is heat welded to the top vinyl layer.

12. The heated inflatable air mattress according to claim 6 wherein the means for blowing air into the air mattress is an electrical powered air blower.

13. The heated inflatable air mattress according to claim 12 wherein the air blower is electrically powered by batteries.

14. The heated inflatable air mattress according to claim 6 wherein the means for supporting the air mattress when inflated are multiple coils positioned between the top and bottom vinyl layers.

15. The heated inflatable air mattress according to claim 6 wherein the air mattress is attached over a second air mattress by welding the air mattress bottom vinyl layer to a top vinyl layer of the second air mattress.

16. A method of constructing an air bed comprising:

providing a top and a bottom vinyl layer having a peripheral edge;

providing a gusset vinyl layer having a top and bottom peripheral edge;

heat welding the top peripheral edge of the gusset vinyl layer to the peripheral edge of the top vinyl layer;

heat welding the bottom peripheral edge of the gusset vinyl layer to the peripheral edge of the bottom vinyl layer to enclose an air chamber;

providing a blanket with internal electrical heating elements, the blanket having a peripheral edge;

stitching a first side of a vinyl strip to the peripheral edge of the blanket;

heat welding a second side of the vinyl strip to the top vinyl layer;

providing an electrical conduit and connecting the conduit at a first end to the heating elements and at a second end to a source of electricity;

providing a means for supporting the air bed, when inflated, between the top and bottom vinyl layers; and providing a means for conducting air to and from the air chamber.

17. The method according to claim 16 wherein an air bed mattress is heat sealed to the bottom vinyl layer of the heated inflatable air bed.

18. The method according to claim 16 wherein a vinyl flock layer is applied over the blanket, the flock layer having a peripheral edge heat sealed to the top vinyl layer.

19. The method according to claim 16 wherein an electrically operated air blower pumps air into the air chamber.

20. The method according to claim 16 wherein collapsible multiple vinyl pillars form coils for supporting the air bed when inflated.

* * * * *